US005591270A

United States Patent [19]

D'Muhala

[11] Patent Number: 5,591,270

[45] Date of Patent: Jan. 7, 1997

[54] LEAD OXIDE REMOVAL METHOD

[75] Inventor: Thomas F. D'Muhala, Raleigh, N.C.

[73] Assignee: Corpex Technologies, Inc., Morrisville, N.C.

[21] Appl. No.: 508,381

[22] Filed: Jul. 31, 1995

[51] Int. Cl.[6] ..... C23G 1/02; B08B 3/00

[52] U.S. Cl. ..... 134/3; 134/2; 134/22.19; 134/28; 134/41

[58] Field of Search ..... 134/2, 3, 28, 22.19, 134/41, 42

[56] References Cited

U.S. PATENT DOCUMENTS

| | | | |
|---|---|---|---|
| 3,496,017 | 2/1970 | Weed et al. | 134/2 |
| 3,873,362 | 3/1975 | Mihram et al. | 134/3 |
| 3,970,239 | 7/1976 | Hill | 228/220 |
| 4,266,640 | 10/1980 | Bertholdt | 134/3 |
| 4,477,285 | 10/1984 | Ault | 134/3 |
| 4,544,462 | 10/1985 | Furutani et al. | 204/129 |
| 4,693,833 | 9/1987 | Toshikuni et al. | 210/759 |
| 4,704,235 | 11/1987 | Arvesen | 252/626 |
| 4,762,693 | 8/1988 | Schimmel et al. | 423/321 S |
| 4,836,900 | 6/1989 | Bellanger | 204/140 |
| 5,045,273 | 9/1991 | Gassen et al. | 376/309 |
| 5,089,217 | 2/1992 | Corpora et al. | 376/313 |
| 5,093,072 | 3/1992 | Guy et al. | 376/310 |
| 5,093,073 | 3/1992 | Schenker | 376/310 |
| 5,098,658 | 7/1978 | Ginatta | 204/114 |
| 5,154,776 | 10/1992 | Bloch | 134/22.1 |
| 5,322,644 | 6/1994 | Dunn et al. | 252/626 |
| 5,358,549 | 10/1994 | Nagel et al. | 75/414 |

*Primary Examiner*—Arlen Soderquist
*Attorney, Agent, or Firm*—Bell, Seltzer, Park & Gibson

[57] ABSTRACT

The present invention provides a method of removing lead oxide from a surface having lead oxide deposited thereon. The method includes contacting the article containing lead contaminated with radioactive material with a decontamination composition comprising about 0.01 to 5 percent, by weight, of a reductant, about 0.01 to 5 percent, by weight, of a compound selected from the group consisting of citric acid, alkali metal and ammonium salts of citric acid and mixtures thereof; 1 to 15 percent, by weight, of a compound selected from the group consisting of polyaminocarboxylic acid, alkali metal and ammonium salts of polyaminocarboxylic acid and the combination of a polyaminocarboxylic acid and a neutralizing compound and mixtures thereof; 0 to 1 percent, by weight, of a nonionic surfactant; 0 to 1 percent, by weight, of a dispersant; and 0 to 1 percent, by weight, of a corrosion inhibitor, and the balance water or other aqueous liquid.

9 Claims, No Drawings

LEAD OXIDE REMOVAL METHOD

FIELD OF THE INVENTION

The present invention relates to the removal of lead oxide from a variety of surfaces.

BACKGROUND OF THE INVENTION

Lead is used for diverse purposes such as storage batteries, radiation shielding, solder and fusible alloys and chemical reaction equipment (e.g., piping, tank linings, etc.). In many of these uses, the deposition of lead oxide and the need for removing the same is often problematic. For example, the deposition of lead oxide can adversely affect the electrical properties of semiconductor devices using lead solder. Another example is that the efficiency of lead-based batteries is reduced by the buildup of lead oxide. In piping, lead oxide can prevent cladding or laminating of lead surfaces with paints, coatings, polymeric binders and the like.

There have been various proposed methods of removing lead oxide from different surfaces. One technique is to spray water or to use an abrasive (e.g., sand) to physically remove the lead oxide from the surface. Another technique is to contact the article having the lead oxide deposited thereon with a strong acid such as a carboxylic or hydroxycarboxylic acid or fluoroboric acid to remove the lead oxide by dissolving it into solution. These techniques often require high temperatures and can adversely affect the surface from which the lead oxide is removed.

Thus, there continues to be a need for a technique of removing lead oxides from a variety of surfaces which does so at room temperature, without using strong acids and without adversely affecting the surface being treated.

SUMMARY OF THE INVENTION

To this end, it is an object of the present invention to provide a method of removing lead oxide from a surface which can be conducted at room temperature. It is another object to provide a method which obviates the need for using potentially hazardous materials such as strong acids and powerful oxidants in the removal method. A feature of the present invention is that the practice of the method thereof does not adversely affect the underlying surface such as the lead surface.

The method of the present invention comprises contacting, preferably at room temperature and at a pH of 2 to 7, and preferably neutral pH, the surface having the lead oxide deposited thereon with a cleaning composition comprising about 0.01 to 5 percent, by weight, of a reductant, about 0.01 to 5 percent, by weight, of a compound selected from the group consisting of citric acid, alkali metal and ammonium salts of citric acid and mixtures thereof; 1 to 15 percent, by weight, of a compound selected from the group consisting of polyaminocarboxylic acid, alkali metal and ammonium salts of polyaminocarboxylic acid and the combination of a polyaminocarboxylic acid and a neutralizing compound and mixtures thereof; 0 to 1 percent, by weight, of a nonionic surfactant; 0 to 1 percent, by weight, of a dispersant; and 0 to 1 percent, by weight, of a corrosion inhibitor, and the balance water or other aqueous liquid. Suitable reductants or reducing agents include ascorbic acid, hydroquinone and various amines such as phenylenediamine and hydroxyamine sulfate.

DETAILED DESCRIPTION OF THE INVENTION

The present invention is described more fully hereinafter. This invention may, however, be embodied in many different forms and should not be construed as limited to the embodiment set forth herein; rather, this embodiment is provided so that this disclosure will be thorough and complete, and will fully convey the scope of the invention to those skilled in the art.

As summarized above, the method comprises contacting, preferably at room temperature and neutral pH, the surface having the lead oxide deposited thereon with a cleaning composition comprising about 0.01 to 5 percent, by weight, of a reductant, about 0.01 to 5 percent, by weight, of a compound selected from the group consisting of citric acid, alkali metal and ammonium salts of citric acid and mixtures thereof; 1 to 15 percent, by weight, of a compound selected from the group consisting of polyaminocarboxylic acid, alkali metal and ammonium salts of polyaminocarboxylic acid and the combination of a polyaminocarboxylic acid and a neutralizing compound and mixtures thereof; 0 to 1 percent, by weight, of a nonionic surfactant; 0 to 1 percent, by weight, of a dispersant; and 0 to 1 percent, by weight, of a corrosion inhibitor, and the balance water (preferably deionized water) or other aqueous liquid. Typically, the contacting is conducted at room temperature and at a pH of 2 to 7, and more preferably neutral pH. Any conventional technique can be employed to contact the cleaning composition with the lead. Contacting of the object may be accomplished by spraying, immersing, showering, etc. with or without agitation, turbulence or the like. After contacting, the article is preferably subjected to a water rinse.

Reductants include ascorbic acid, hydroquinone and various amines (e.g., phenylenediamine and hydroxyamine sulfate).

The alkali metal and ammonium salts of the citric acid can include mono- and disubstituted salts. A particularly preferred ammonium salt of citric acid is ammonium citrate.

Suitable polyaminocarboxylic acids include ethylenediaminetetraacetic acid, diethylenetriaminepentaaceticacid, triethylenetetraaminehexaacetic acid, N-2-hydroxyethylethylenediaminetriacetic acid, propylene-1,2-diaminetetraacetic acid, propylene-1,3-diaminetetraacetic acid, nitrilotriacetic acid, the ammonium and alkali metal salts of said acids, and the combination of the polyaminocarboxylic acids with a neutralizing compound, and mixtures thereof. The alkali metal and ammonium salts can include mono- and disubstituted salts. A particularly preferred polyaminocarboxylic acid is ethylenediaminetetraacetic acid. A suitable neutralizing compound is hydrazine.

Suitable nonionic surfactants include Triton X-100, a octylphenoxy-polyethoxyethanol with 9 to 10 moles of ethylene oxide surfactant, available from Union Carbide, Danbury, Conn., and Pluronic L-101, a polyoxyethylene-polyoxypropylene block polymer surfactant, available from BASF-Wyandotte, Wyandotte, Mich. A suitable dispersant for organic solids is Tamol SN, a sodium salt napthalene-sulfonic acid, available from Rohm & Haas, Philadelphia, Pa. A suitable dispersant for inorganic solids is sodium lignosulfonate. A suitable corrosion inhibitor is Rodine 95, which includes thiourea, formaldehyde, o-toluidine and substituted triazine hydrochloric acid, available from Parker +Amchem, Madison Heights, Mich.

The solution containing the dissolved lead oxide and minor amounts of dissolved lead can be recovered from solution using known techniques such as by ion exchange, selective adsorption, reagent destruction, filtration, precipitation or a combination of these techniques. The recovered radioactive material can be compacted and disposed of, for example, using conventional burial techniques. The lead thusly decontaminated can be reused or released to the public for use in another form such as in batteries or the like.

EXAMPLE 1

The following composition is blended together:

| Component | Amount |
|---|---|
| Diammonium EDTA | 160 g |
| Diammonium Citrate | 15 g |
| Ascorbic Acid | 15 g |
| Triton X-100 | 3 mL |
| Deionized Water | 1.2 L |

A lead coupon (40.45 g) with a dull lead oxide layer is immersed in the cleaning composition at 19° C. After 15 seconds the coupon is removed, rinsed with deionized water and dried. The coupon weighed 40.38 g. The coupon has a metallic sheen. The coupon is then re-immersed in the cleaning composition for 7 hours, removed, rinsed and weighed (40.36 g). This shows that there is rapid removal of the lead oxide without any adverse affect over an extended period.

That which is claimed is:

1. A method of removing lead oxide from a surface having the lead oxide deposited thereon, the method comprising contacting the article with a decontamination composition comprising about 0.01 to 5 percent, by weight, of a reductant, about 0.01 to 5 percent, by weight, of a compound selected from the group consisting of citric acid, alkali metal and ammonium salts of citric acid and mixtures thereof; 1 to 15 percent, by weight, of a compound selected from the group consisting of polyaminocarboxylic acid, alkali metal and ammonium salts of polyaminocarboxylic acid and the combination of a polyaminocarboxylic acid and a neutralizing compound and mixtures thereof; 0 to 1 percent, by weight, of a nonionic surfactant; 0 to 1 percent, by weight, of a dispersant; and 0 to 1 percent, by weight, of a corrosion inhibitor, and the balance water or other aqueous liquid.

2. The method according to claim 1 wherein the reductant is selected from the group consisting of ascorbic acid, hydroquinone and phenylenediamine, hydroxyamine sulfate.

3. The method according to claim 1 wherein the polyaminocarboxylic acid is selected from the group consisting of ethylenediaminetetraacetic acid, diethylenetriaminepentaacetic acid, triethylenetetraaminehexaacetic acid, N-2-hydroxyethylethylenediaminetriacetic acid, propylene-1,2-diaminetetraacenic acid, propylene-1,3-diaminetetraacetic acid, nitrilotriacetic acid, the ammonium and alkali metal salts of said acids, and the combination of said acids with neutralizing compounds and mixtures thereof.

4. The method according to claim 1 wherein the polyaminocarboxylic acid is ethylenediaminetetraacetic acid.

5. The method according to claim 1 wherein the citric acid is diammonium citrate.

6. A method of removing lead oxide from a surface having the lead oxide deposited thereon, the method comprising contacting the article at room temperature with a decontamination composition comprising about 0.01 to 5 percent, by weight, of an ascorbic acid, about 0.01 to 5 percent, by weight, of a compound selected from the group consisting of citric acid, alkali metal and ammonium salts of citric acid and mixtures thereof; 1 to 15 percent, by weight, of a compound selected from the group consisting of polyaminocarboxylic acid, alkali metal and ammonium salts of polyaminocarboxylic acid and the combination of a poiyaminocarboxylic acid and a neutralizing compound and mixtures thereof; 0 to 1 percent, by weight, of a nonionic surfactant; 0 to 1 percent, by weight, of a dispersant; and 0 to 1 percent, by weight, of a corrosion inhibitor, and the balance water or other aqueous liquid.

7. The method according to claim 6 wherein the polyaminocarboxylic acid is selected from the group consisting of ethylenediaminetetraacetic acid, diethylenetriaminepentaacetic acid, triethylenetetraaminehexaacetic acid, N-2-hydroxyethylethylenediaminetriacetic acid, propylene- 1,2-diaminetetraacetic acid, propylene-1,3-diaminetetraacetic acid, nitrilotriacetic acid, the ammonium and alkali metal salts of said acids, and the combination of said acids with neutralizing compounds and mixtures thereof.

8. The method according to claim 6 wherein the polyaminocarboxylic acid is ethylenediaminetetraacetic acid.

9. The method according to claim 6 wherein the citric acid is diammonium citrate.

* * * * *